US005606917A

United States Patent [19]

Cauffiel

[11] Patent Number: 5,606,917

[45] **Date of Patent: *Mar. 4, 1997**

[54] TABLE ASSEMBLY WITH SLIDABLE TABLE

[76] Inventor: Ford B. Cauffiel, 4126 Nantucket Dr., Toledo, Ohio 43623

[ * ] Notice: The term of this patent shall not extend beyond the expiration date of Pat. No. 5,293,825.

[21] Appl. No.: 537,232

[22] Filed: Sep. 29, 1995

Related U.S. Application Data

[63] Continuation of Ser. No. 153,090, Nov. 17, 1993, abandoned.

[51] Int. Cl.[6] ..... A47B 23/00

[52] U.S. Cl. ..... 108/42; 108/49; 297/135

[58] Field of Search ..... 108/42, 49, 106, 108/144; 297/144, 135, 423.1, 423.39, 423.4, 170, 172; 248/188, 345.1

[56] References Cited

U.S. PATENT DOCUMENTS

| | | | |
|---|---|---|---|
| 1,653,657 | 12/1927 | Pretsch | 108/49 X |
| 2,357,668 | 9/1944 | Laham | 108/143 X |
| 2,681,840 | 6/1954 | Miller | 108/49 X |
| 3,232,249 | 2/1966 | Perez | 108/42 |
| 3,698,328 | 10/1972 | Weir | 108/49 X |
| 5,129,702 | 7/1992 | Ervin | 108/49 X |
| 5,479,865 | 1/1996 | Cauffiel | 108/49 X |

FOREIGN PATENT DOCUMENTS

| | | | |
|---|---|---|---|
| 24033 | 1/1990 | Japan | 108/143 |
| 208625 | 12/1923 | United Kingdom . | |
| 407696 | 3/1924 | United Kingdom . | |
| 361600 | 11/1931 | United Kingdom | 297/172 |

*Primary Examiner*—Jose V. Chen
*Attorney, Agent, or Firm*—Allen D. Gutchess, Jr.

[57] ABSTRACT

A table assembly for use with seating apparatus has a base plate of sufficient size to fit under supports on at least one side of the seating apparatus. The seating apparatus stabilizes and supports the base plate which has a sleeve or the like at a forward portion thereof. An elongate member or post extends upwardly from the sleeve to support an end portion of a table. The elongate member can be of a telescoping design with a clamp for holding the table at a desired height. A track arrangement is affixed to an upper end of the post and to the bottom of the table to enable the table to slide between an out-of-the-way position and an operating position over the seating apparatus.

12 Claims, 1 Drawing Sheet

TABLE ASSEMBLY WITH SLIDABLE TABLE

This is a continuation of application Ser. No. 08/153,090, filed Nov. 17, 1993 now abandoned.

This invention relates to a table assembly with a sliding table for use with seating apparatus.

The seating apparatus can include chairs, wheelchairs, sofas, love seats, and the like. The table assembly includes a base plate of sufficient size to fit under the front and back legs or other supporting structure on at least one side of the seating apparatus and is removable. A lower supporting sleeve or the like is affixed to a forward, outer portion of the base plate and extends upwardly therefrom. An elongate member or post has a lower end engagable with the sleeve and preferably can be separated therefrom.

A table of the TV type is supported by the upper end of the post and the base plate provides stabilizing and supporting means for the post and the table. Track means are located between the upper end of the post and the table to enable the table to be slid horizontally relative to the base plate between an operating position over the seating apparatus and an out-of-the-way position to one side of the seating apparatus. The track means includes a short, lower member which is mounted on the upper end of the post by a sleeve, for example. The track means also includes a longer, upper member affixed to the bottom of the table and extending a substantial portion of the length thereof. The two track members are engagable to support the table relative to the post and yet to enable the table to slide relative to the post.

The post can be made in two sections which telescope for height adjustment of the table. A clamp is mounted on the post and holds the table at a desired height when the clamp is tightened. A magazine rack can be located on an outer portion of the base plate adjacent the lower sleeve.

It is, therefore, a principal object of the invention to provide a table assembly for use with seating apparatus having a slidably mounted table.

Many other objects and advantages of the invention will be apparent from the following detailed description of preferred embodiments thereof, reference being made to the accompanying drawings, in which.

Figure 1:
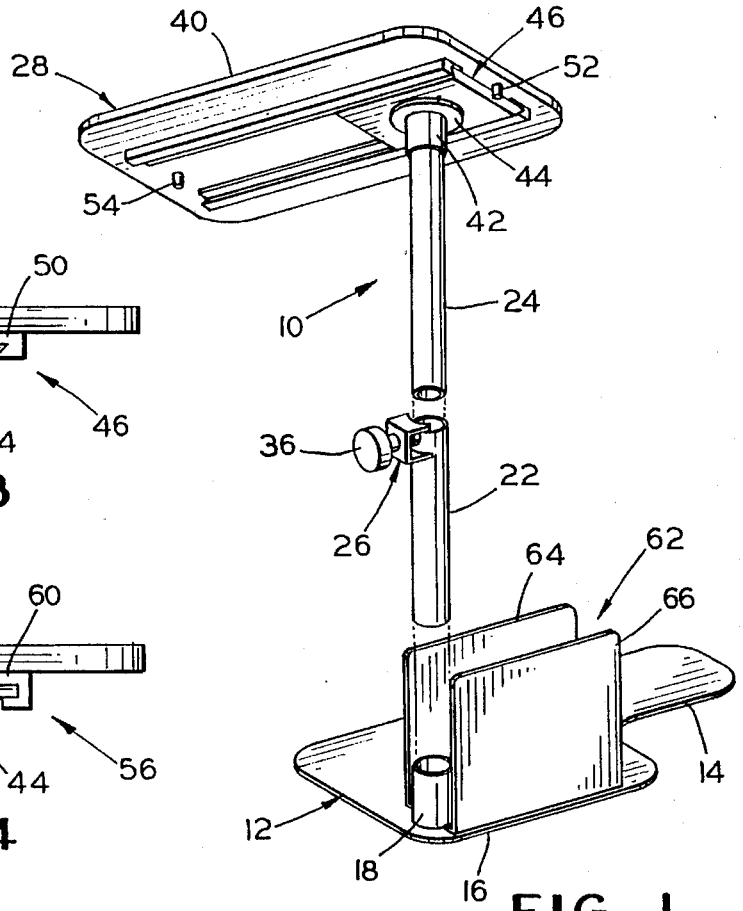
FIG. 1 is an exploded view in perspective of a table assembly in accordance with the invention.
Figure 2:
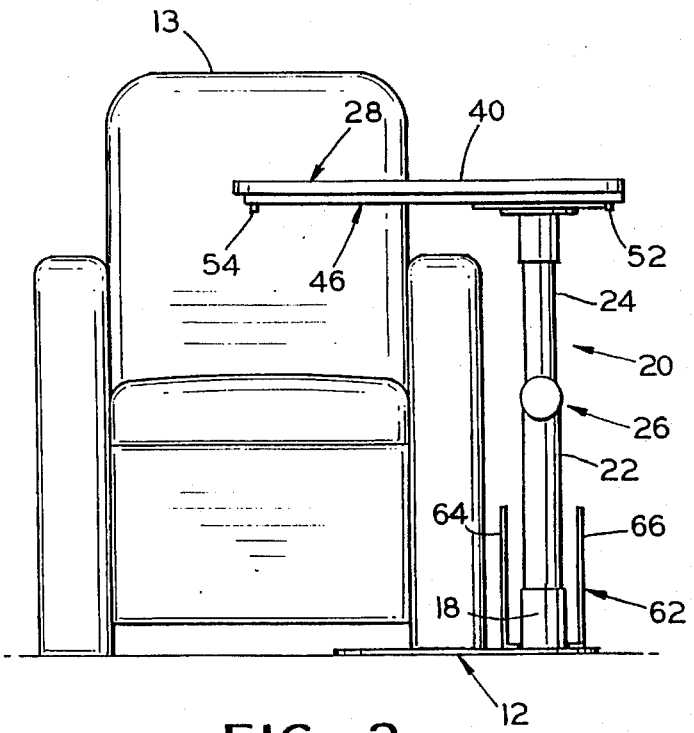
FIG. 2 is a somewhat schematic front view in elevation of the table assembly of FIG. 1, in place with a chair.

Referring to the drawings, and particularly to FIG. 1, a TV table assembly in accordance with the invention is indicated at 10. It includes a base plate 12 of a sufficient size to be placed under seating apparatus supports on one side of the seating apparatus 13 (FIG. 2). The seating apparatus 13 can include chairs, sofas, love seats, and wheelchairs, by way of example. However, for wheelchairs, it is preferred that the plate be wide enough to receive both rear wheels of the wheelchair. The seating apparatus supports can be front and rear legs or runners that extend most of the depth of the seating apparatus. In any event, the base plate 12 is supported and held in position by at least one side of the seating apparatus. More specifically, the base plate 12 includes a narrow rear portion 14 extending rearwardly from a front wide portion 16. A lower sleeve or cylinder 18 extends upwardly from an outer forward portion of the wide portion 16 of the base plate 12. It can be affixed to the base plate 12 by any suitable means such as a threaded fastener and bolt (not shown) or by welding.

Figure 4:
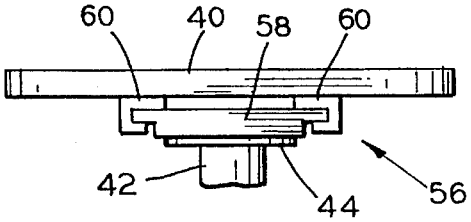
FIG. 4 is a view similar to FIG. 3 showing a modified track assembly.
Figure 5:
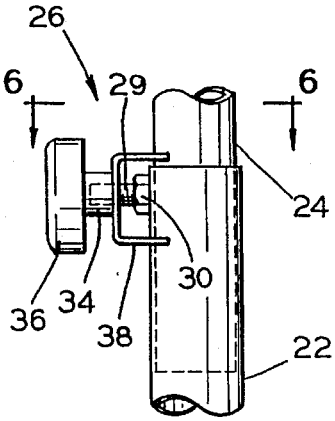
FIG. 5 is a fragmentary view in elevation of a two-section elongate member providing a height adjustment for the table.
Figure 6:
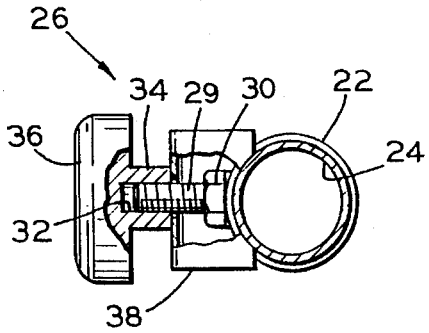
FIG. 6 is a view in cross section taken along the line 6—6 of FIG. 5, with parts broken away and in section.

An upright supporting post 20 has a lower section 22 and a telescoping, upper section 24. The lower end of the section 22 is received in or over the cylinder 18 and preferably can pivot relative thereto as well as be removed. The lower end of the upper section 24 of the post 20 telescopes into the lower section 22, as shown in FIGS. 4 and 5, and is held in place by a clamp 26 when a table 28 at the upper end of the post 20 is at a desired height or distance from the base plate 12.

The clamp 26 includes a threaded stud 29 affixed to an upper end of the post section 22 by welding through a base nut 30. The threaded stud 29 is threadedly received in a bore 32 of a shank 34 of an adjusting knob 36. A generally C-shaped clamping plate 38 has concave edges which engage the upper end of the post section 22 and a lower portion of the post section 24 when in a desired position. The adjusting knob 36 is turned to tighten the clamping plate against the post sections and hold them firmly in position.

An elongate panel 40 of the table 28 is supported on the post 20 and is of ample size and strength to comfortably hold and support food and refreshment, being fourteen inches wide and twenty-four inches long, by way of example. The table panel 40 can be of wood with an attractive finish thereon.

Figure 3:
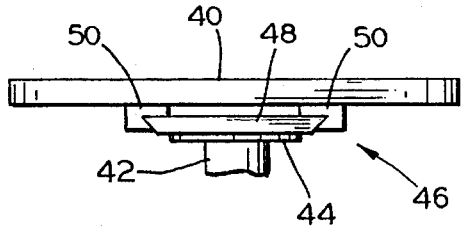
FIG. 3 is a somewhat schematic end view in elevation of a track assembly used with a post and table of the table assembly.

An upper sleeve or cylinder 42 is received in or over the upper section 24 of the post 20 and has a plate 44 affixed to a track assembly or means indicated at 46. A lower, stationary track member 48 (FIG. 3) is suitably affixed to the plate 44. The member 48 is relatively small, typically being six inches wide and eight inches long. As shown, it is of dovetail configuration as viewed from the end or in transverse cross section. An upper track member comprises two elongate members or rails 50 which are suitably affixed to a bottom surface of the table panel 40, as by screws, and extend most of the length of the table panel. The rails 50 have inwardly-facing, slanted surfaces forming grooves near the bottom surface of the table panel to receive slanted edges of the lower track member 40 in interlocking, but slidable relationship. This enables the table panel to be securely supported by the post 20 yet enables the panel to be slidable in a horizontal plane between an operating position over a front portion of the seat of the chair 13, as shown in FIG. 2, and an out-of-the-way position with an end of the table panel over an arm of the chair. In the latter position, a person can easily sit in or arise from the chair. Stop means in the form of pins 52 and 54 are located at end portions of the rails 50 to limit movement of the table panel 40 in both directions.

The lower and upper track members 48 and 50 could be reversed with the lower track member 48 accordingly being lengthened and the upper track member 50 accordingly being shortened and mounted on the post. However, the manufacture of these members would be more complicated since the rails 50 would require a web between them for mounting on the plate 44 and the track member 48 would be much longer, extending the length of the table panel, and would be heavier.

A modified track assembly or means indicated at 56 is shown in FIG. 4. A lower, stationary track member 58 is suitably affixed to the plate 44 and is generally of the same dimensions as the member 48. In this instance, the track member 58 is of squat, T-shaped configuration. An upper track member comprises two rails 60 which are of C-shaped configuration and form grooves near the bottom surface of the table panel 40. The rails 60 extend most of the length of the panel and receive the ends of the lower track member 58 in interlocking, but slidable, relationship. Again, this enables the table panel to be securely supported by the post 20 and yet be slidable in a horizontonal plane as is true of the track assembly 46. Suitable stop means can again be located at end portions of the rails 60 to limit movement of the table panel 40. Like the track members 48 and 50, the track members 58 and 60 could also be reversed.

A magazine rack 62 can be located on the base plate 12 and preferably on the wider portion 16 thereof. The magazine rack 62 includes two upright panels 64 and 66 which have ends adjacent and preferably partially encompassing the lower sleeve 18. This provides a more aesthetic appearance and lessens the possibility of a person tripping over the sleeve. The panels 64 and 66 can be suitably affixed to the base plate, as by welding.

Various modifications of the above-described embodiments of the invention will be apparent to those skilled in the art, and it is to be understood that such modifications can be made without departing from the scope of the invention, if they are within the spirit and the tenor of the accompanying claims.

I claim:

1. A table assembly for use with seating apparatus, said assembly comprising stabilizing means defined by a base plate of sufficient size to be received under and held stationary by supports on at least one side of the seating apparatus for supporting said assembly, said base plate having a flat bottom surface defining a floor-engaging means for contacting a floor under the seating apparatus, an upright post, first means on said base plate to support a lower end of said post on said plate, a table, track means on an upper end of said post and on a lower surface of said table to enable said table to slide linearly in a substantially horizontal plane relative to said base plate, and a magazine rack affixed to said base plate adjacent said first means, said magazine rack comprising two panels affixed to said base plate and extending upwardly on either side of said first means.

2. A table assembly according to claim 1 wherein said track means comprises a lower track member affixed to an upper end of said post and an upper track member affixed to the lower surface of said table, extending substantially the length of said table, and mechanically interlocked in slidable relationship with said lower track member.

3. A table assembly according to claim 2 wherein said upper track member comprises a pair of parallel rails affixed to the lower surface of said table.

4. A table assembly according to claim 2 wherein said lower track member is of dovetail shape in transverse cross section.

5. A table assembly according to claim 2 wherein said lower track member is of T-shaped configuration in transverse cross section.

6. In combination, a table and seating apparatus, said assembly comprising stabilizing means defined by a base plate received under and held stationary by supports on at least one side of said seating apparatus for supporting said assembly, said base plate having a flat bottom surface defining a floor-engaging means contacting a floor under the seating apparatus, an upright post, first means extending upwardly from said base plate to support a lower end of said post on said plate, a table having an upper flat surface and a lower surface and being elongate in shape and of ample size to hold food, track means on an upper end of said post and on the lower surface of said table to enable said table to slide in a horizontal plane between a position over the seating apparatus and a position to one side of said seating apparatus, and a magazine rack affixed to said base plate adjacent said first means, said magazine rack comprising two panels affixed to said base plate and extending upwardly on either side of said first means.

7. The combination according to claim 6 wherein said track means comprises a lower track member affixed to an upper end of said post and an upper track member affixed to the lower surface of said table, extending substantially the length of said table, and mechanically interlocked in slidable relationship with said lower track member.

8. The combination according to claim 7 wherein said upper track member comprises a pair of parallel rails affixed to the lower surface of said table.

9. The combination according to claim 7 wherein said lower track member is of dovetail shape in transverse cross section.

10. The combination according to claim 7 wherein said lower track member is of T-shaped configuration in transverse cross section.

11. The combination according to claim 6 wherein means are associated with said post to adjust the height of said table relative to said base plate.

12. A table assembly for use with seating apparatus, said assembly comprising a base plate to be received under supports on at least one side of said seating apparatus for supporting said table assembly, said base plate having a narrow rear portion and a wide forward portion, an upright post, lower sleeve means affixed to and extending upwardly from an outer portion of the wide portion of said base plate to receive a lower end of said post, a table having an upper flat surface and a lower flat surface, upper sleeve means receiving an upper end of said post, track means on an upper end of said upper sleeve means and on the lower surface of said table to enable said table to slide in a substantially horizontal plane relative to said base plate, means associated with said post to adjust the height of said table relative to said base plate, and a magazine rack affixed to said base plate adjacent said lower sleeve means, said magazine rack comprising two panels affixed to said base plate and extending upwardly on either side of said lower sleeve means.

* * * * *